US006151934A

United States Patent [19]

Chong et al.

[11] Patent Number: 6,151,934

[45] Date of Patent: Nov. 28, 2000

[54] LOCK ASSEMBLY WITH OVER-TORQUE DEFENSE SYSTEM

[75] Inventors: Gerald B. Chong, Rowland Heights; Christopher L. Taylor, Anaheim, both of Calif.

[73] Assignee: Emhart Inc., Newark, Del.

[21] Appl. No.: 09/422,695

[22] Filed: Oct. 21, 1999

Related U.S. Application Data

[60] Provisional application No. 60/105,457, Oct. 23, 1998.

[51] Int. Cl.[7] ..... E05B 13/10

[52] U.S. Cl. ..... 70/221; 70/224; 70/422; 70/472

[58] Field of Search ..... 70/422, 224, 472, 70/149, 188, 189, 218, 221; 292/DIG. 27

[56] References Cited

U.S. PATENT DOCUMENTS

| | | | |
|---|---|---|---|
| 2,063,708 | 12/1936 | Swilens | 70/422 |
| 2,138,856 | 12/1938 | Harp | 70/422 |
| 2,609,679 | 9/1952 | Bremer et al. | 70/422 |
| 4,195,502 | 4/1980 | Best et al. | 70/422 X |
| 4,426,858 | 1/1984 | Interrante | 292/225 X |
| 4,550,581 | 11/1985 | Best et al. | 70/422 |
| 4,589,691 | 5/1986 | Foshee et al. | 292/165 |
| 4,667,994 | 5/1987 | Foshee | 292/1 X |

*Primary Examiner*—Lloyd A. Gall
*Attorney, Agent, or Firm*—Harness, Dickey & Pierce, P.L.C.

[57] ABSTRACT

A lockset mechanism (20, 120) is provided with a spindle subassembly (24, 124) having a spindle component (44, 128) particularly configured to fracture when an over-torque is applied thereto for uncoupling the handle subassembly (22, 122) from the latch bolt subassembly (26). A spring mechanism (64, 130) is operably disposed between the lockset housing (32, 164) and the spindle subassembly (24, 124) for urging the spindle subassembly (24, 124) including the fractured spindle component (44, 128) away from the handle subassembly (22, 122) to render the lockset mechanism (20, 120) inoperable thereby.

11 Claims, 6 Drawing Sheets

LOCK ASSEMBLY WITH OVER-TORQUE DEFENSE SYSTEM

CROSS REFERENCE TO RELATED APPLICATIONS

This application is a new, non-continuing patent application claiming priority from U.S. Provisional Application No. 60/105,457 entitled "Lock Assembly With Low-Cost Over-Torque Defense System" by Gerald B. Chong and Christopher L. Taylor on Oct. 23, 1998.

TECHNICAL FIELD

The present invention relates generally to a lockset mechanism adapted to provide a torque-releasable knob for defeating a forced entry attack, and more particularly to a lockset mechanism having a spindle subassembly operable in an enabled mode wherein a handle subassembly is operably coupled to a latch bolt subassembly through the spindle subassembly for normal actuation of the lockset mechanism and a disabled mode wherein the handle subassembly is uncoupled from the latch subassembly as a result of an over-torque force having been applied to the spindle subassembly causing it to fracture.

BACKGROUND ART

A variety of door lockset mechanisms operable for selectively closing and locking a door are generally known in the art. In principle, the door knob is mounted on a knob sleeve or spindle which is adapted to be blocked from rotation by manipulation of a turn mechanism or the like operably mounted on the knob, thus preventing operation of the latch bolt subassembly. The outside door knob may incorporate a key-actuated lock mechanism for actuating the locking mechanism. One method of forced entry attack on such lockset mechanism is to apply a high turning force or over-torque on the outside knob, as with a pipe wrench or other tool, sufficient to break or overpower the mechanism which blocks the knob spindle from rotation, thereby actuating the knob sleeve to retract the latch bolt.

DISCLOSURE OF THE INVENTION

In accordance with the principles of the present invention, a preferred embodiment of the lockset mechanism includes a spindle subassembly having a full-round spindle mounted within a half-round spindle. The half-round spindle is drivingly connected to a sleeve, which in turn is drivingly connected to a handle subassembly. When the lockset mechanism is in the unlocked condition, the sleeve, half-round spindle and full-round spindle are free to rotate within the lockset housing such that the half-round spindle actuates a latch bolt. When the lockset mechanism is in the locked condition, the spindle subassembly is constrained from rotation by means of a locking slide which connects the spindle subassembly to the lockset housing. Upon application of an over-torque to the handle subassembly, the half-round spindle will fracture, and a spring operably coupled between the lockset housing and the spindle subassembly urges the full-round spindle out of driving engagement with the handle subassembly. Thus, the spindle subassembly is disabled and the handle subassembly is uncoupled from the latch bolt subassembly. As a result, when the over-torque condition is reached, the defense system of the present invention will not operate the latch and the handle subassembly will otherwise spin freely.

Accordingly, it is an object of the present invention to provide a lockset mechanism having a spindle subassembly operable in an enabled mode whereby the handle subassembly is operably coupled to the latch bolt subassembly, and further operable in a disengaged mode when an over-torque has been applied to the handle subassembly for uncoupling the connection with the latch bolt subassembly.

It is another object of the present invention to provide a spindle subassembly having a full-round spindle mounted within a half-round spindle which is operably coupled to a driving sleeve of the handle subassembly, in which the half-round spindle is particularly configured to fracture upon application of an over-torque force.

It is a further object of the present invention to provide a spindle subassembly having a spring operably associated therewith for urging a portion of the spindle subassembly out of engagement with the handle subassembly upon application of an over-torque force.

It is yet another object of the present invention to provide a spindle subassembly having an over-torque defense system which is readily adaptable into existing lockset mechanism designs.

These and other objects, features and advantages of the present invention will become apparent from the following description when viewed in accordance with the accompanying drawings and appended claims.

MODES OF CARRYING OUT THE INVENTION

Figure 1:
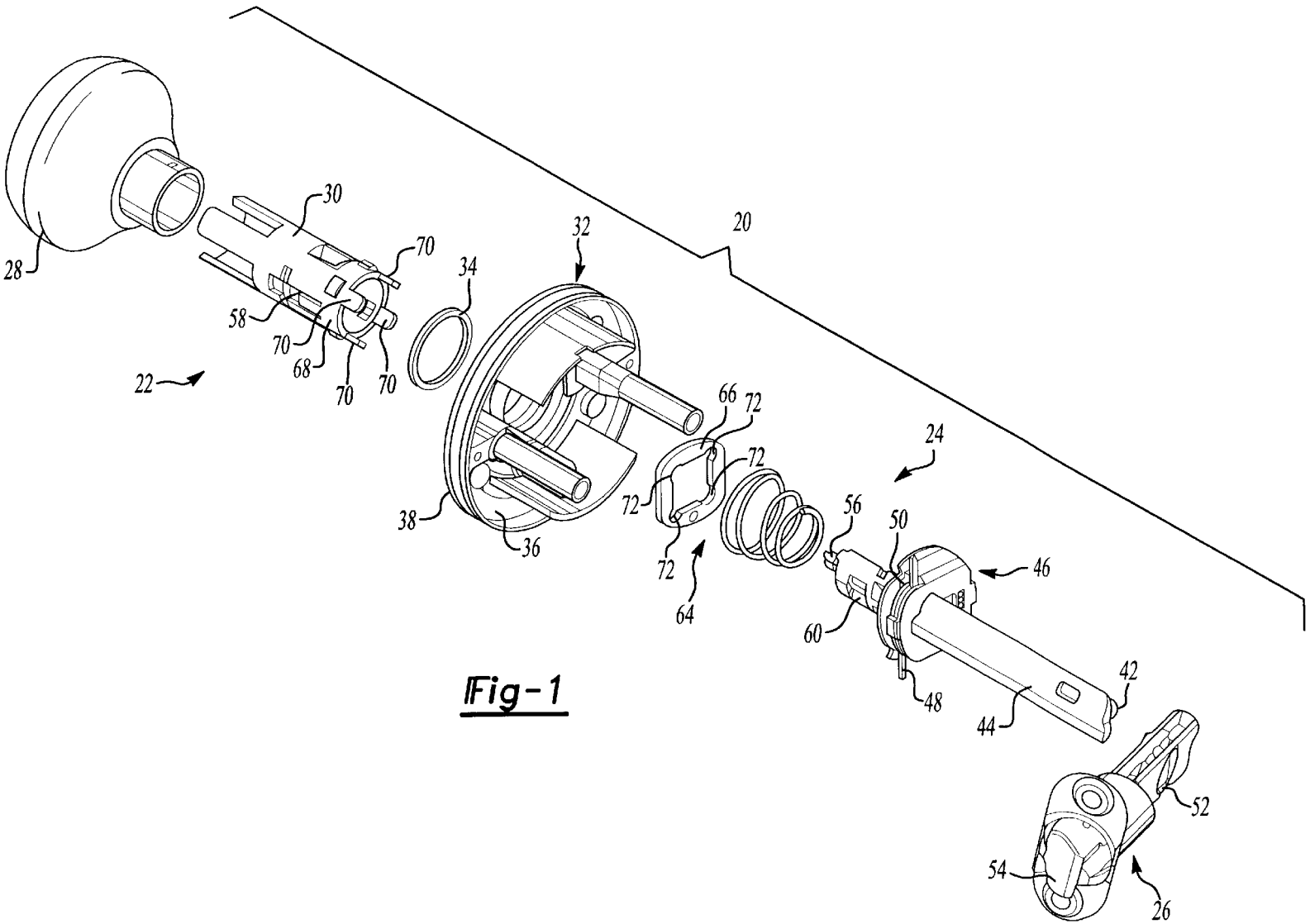
FIG. 1 is an exploded perspective view of a portion of the lockset mechanism including the spindle subassembly in accordance with the present invention.
Figure 2:
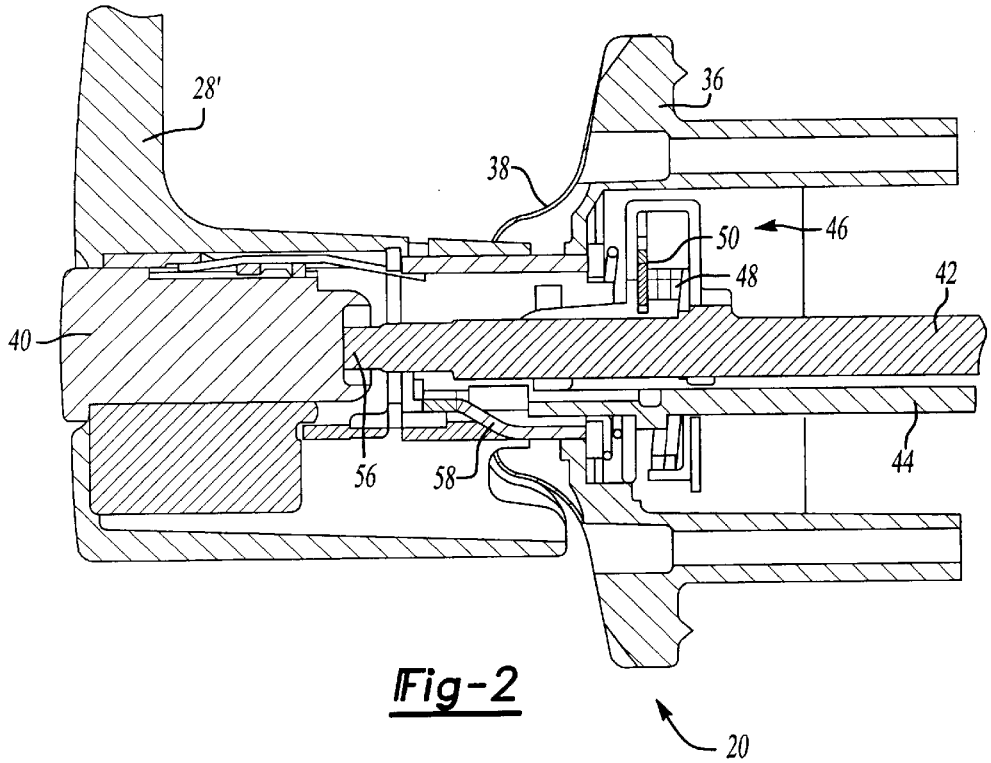
FIG. 2 is a transverse cross-section of a lockset mechanism illustrating the spindle subassembly in an enabled mode.
Figure 3:
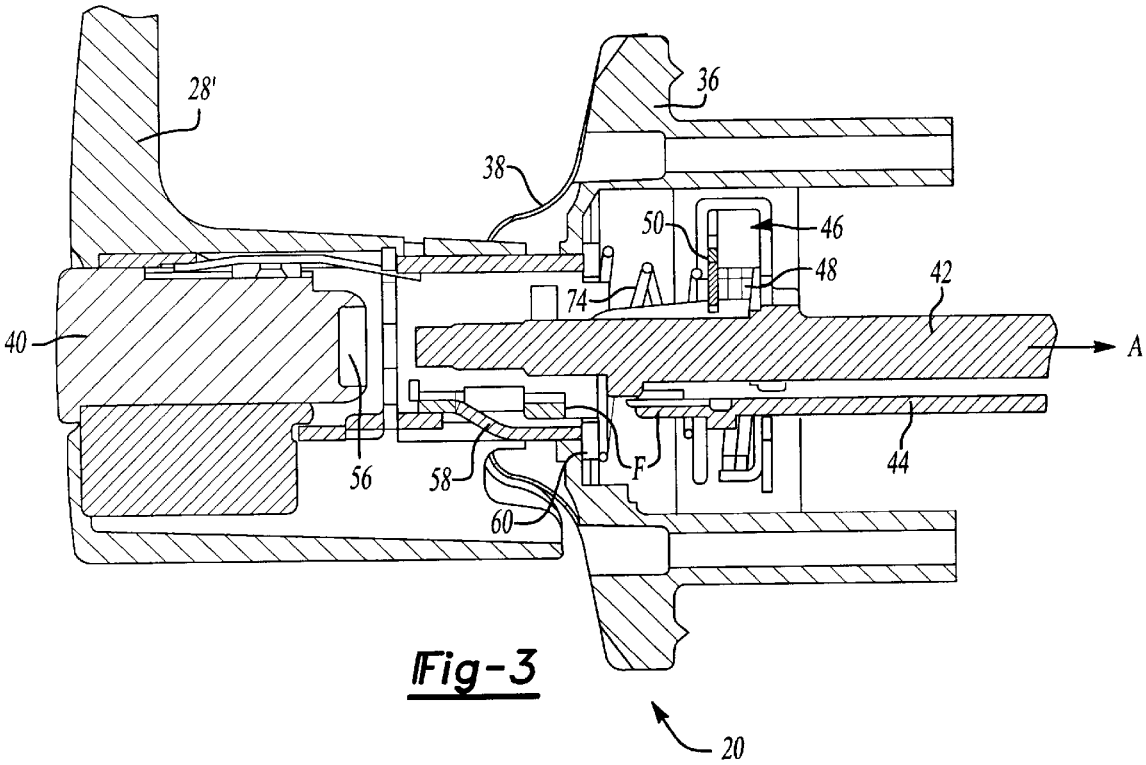
FIG. 3 is a transverse cross-sectional view of the lockset mechanism shown in FIG. 2, with the exception that the spindle subassembly is in a disabled mode.
Figure 4:
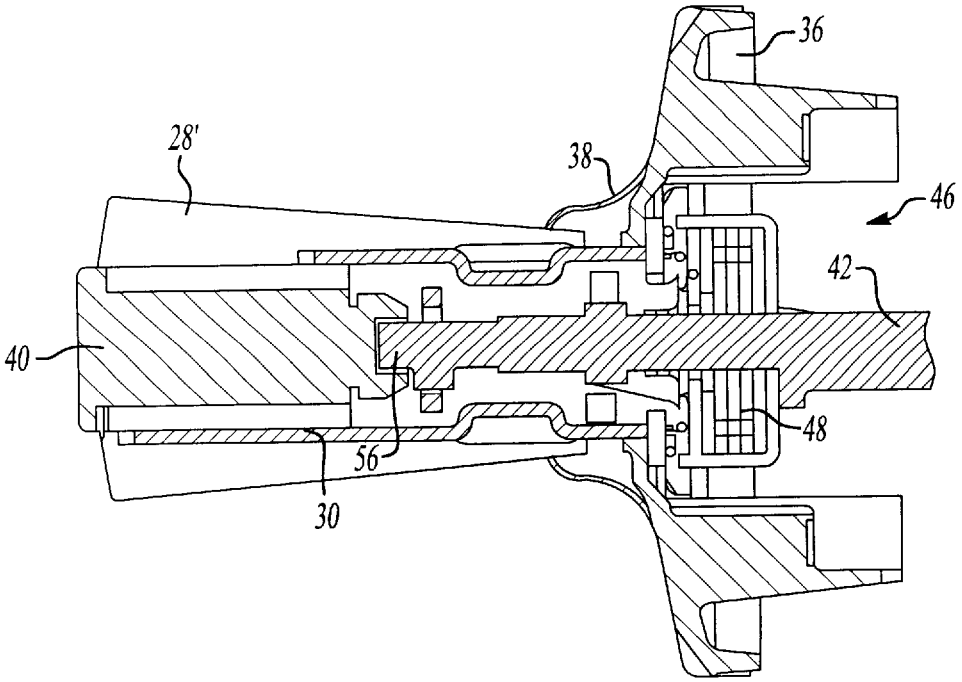
FIG. 4 is a vertical cross-sectional view of the lockset mechanism illustrated in FIG. 2.
Figure 5:
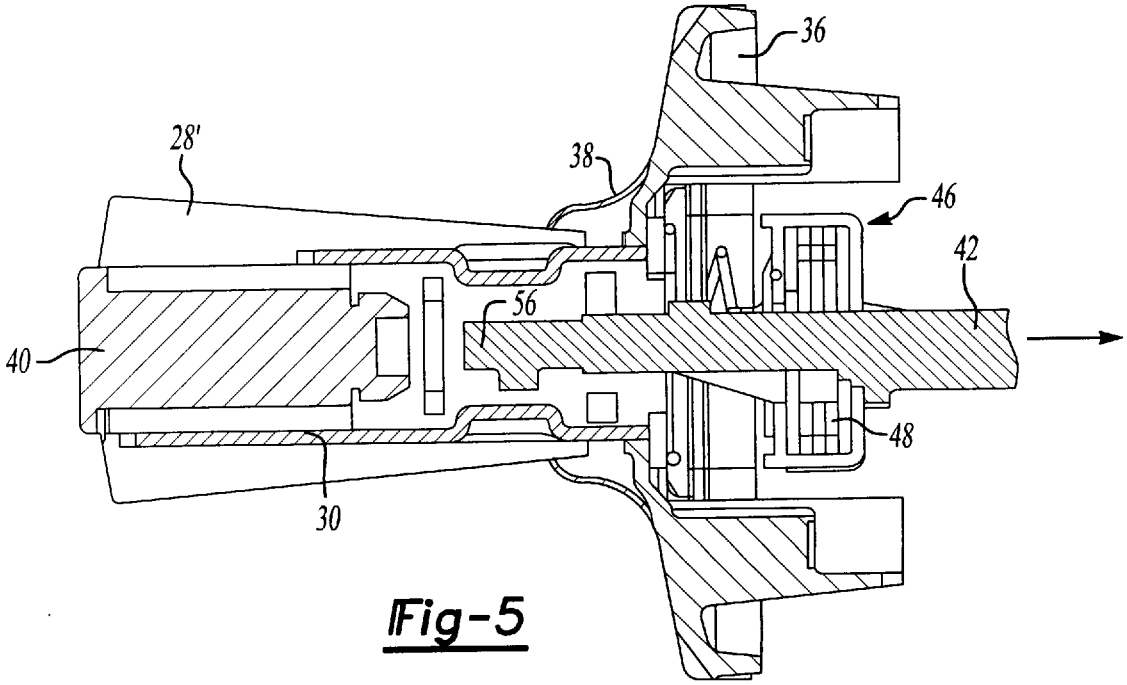
FIG. 5 is a vertical cross-sectional view of the lockset mechanism illustrated in FIG. 3.
Figure 6:
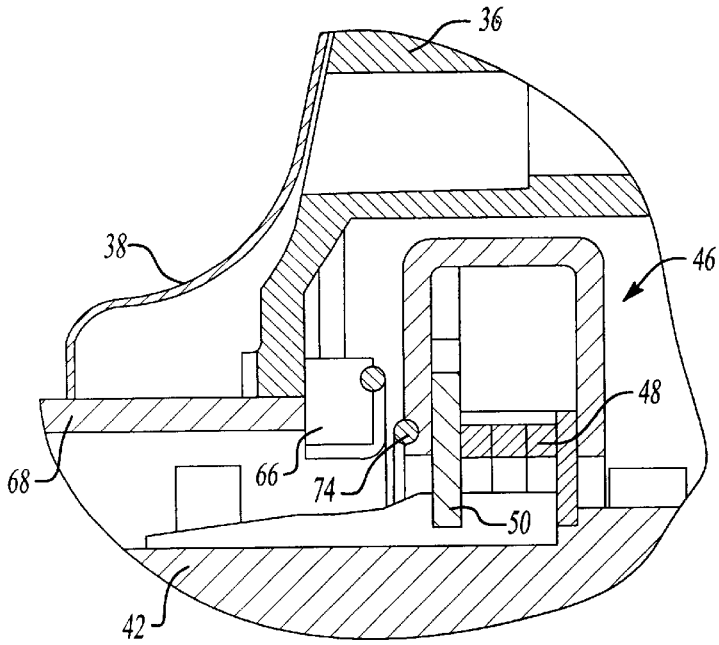
FIG. 6 is a detailed cross-sectional view showing the interface between the spindle subassembly and a portion of the lockset housing.

With reference to FIGS. 1–9, a first preferred embodiment of the present invention is illustrated including lockset mechanism 20 having handle subassembly 22, spindle subassembly 24 and latch bolt subassembly 26. Handle subassembly 22 includes knob 28 secured to exterior sleeve 30 for rotation therewith. Exterior sleeve 30 is received within a central aperture formed in exterior rose 32 and releasably secured therein by support washer 34 such that knob 28 and exterior sleeve 30 are rotatably supported within exterior rose 32. Exterior rose 32 includes rose liner 36 and rose cover 38 releasably secured over rose liner 36 for providing a finished cosmetic appearance. The particular design of knob 28 may be of any conventional design including a generally spherical knob as illustrated in FIG. 1, a lever-type knob as illustrated in FIGS. 2 and 3 or alternately any other suitable shape. Typically, knob 28 is adapted to receive a keyed lock cylinder 40 operably coupled to spindle subassembly 24 for selectively locking and unlocking lockset mechanism 20.

Spindle subassembly 24 includes full-round spindle 42 and half-round spindle 44 operably coupling handle subassembly 22 with latch bolt subassembly 26. Torsion spring mechanism 46 includes torsion spring 48 operably coupled between half-round spindle 44 and rose liner 36 for providing a biased return torque for maintaining latch bolt subassembly 26 in an extended position. Torsion spring mechanism 46 further includes locking slide 50 operably coupled to full-round spindle 42 and slidably positionable upon rotation of full-round spindle 42 between a locked condition wherein slide 50 engages the housing for disabling rotation of spindle subassembly 24 and an unlocked condition for disengaging the housing to permit rotation of spindle subassembly 24. Full-round spindle 42 and half-round spindle 44 are received in an aperture 52 formed in latch bolt subassembly 26. Half-round spindle 44 is operably coupled to latch bolt 54 such that rotation of handle subassembly 22 actuates latch bolt subassembly 26 for movement between an extended position and a retracted position.

The exterior end 56 of full-round spindle 42 is operably coupled to lock cylinder 40 such that rotation of a keyed member in lock cylinder 40 rotates full-round spindle 42 causing slide 50 to move between the locked and unlocked state. The end of fullround spindle 42 opposite exterior end 56 may be adapted to receive a lock turn mechanism operably associated with an interior knob assembly (not shown) of lockset mechanism 20 for manipulating slide 50 between the locked and unlocked state.

Figure 7:
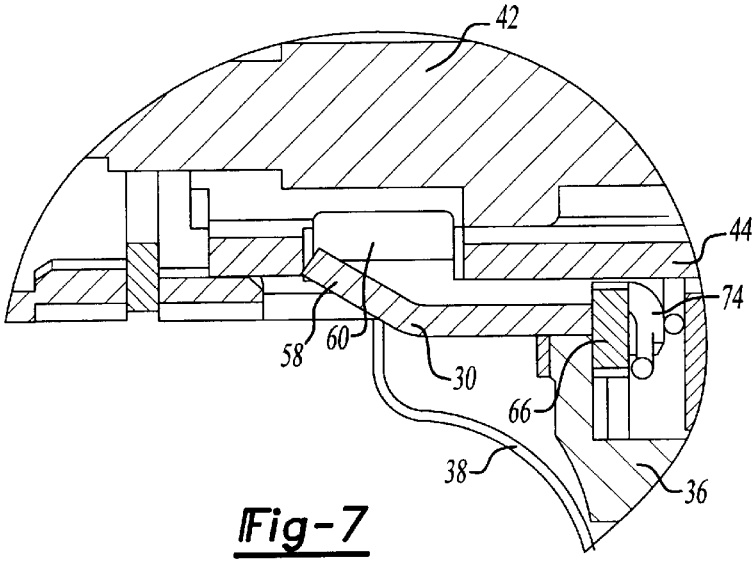
FIG. 7 is a detailed cross-sectional view showing the interface between the spindle subassembly and the handle subassembly.

Half-round spindle 44 is operably coupled to exterior sleeve 30 for co-rotation therewith. As best seen in FIG. 7, exterior sleeve 30 has a tab 58 projecting inwardly therefrom which is received within a slot 60 formed in half-round spindle 44. In this manner, tab 58 axially positions and rotatably couples half-round spindle 44 with exterior sleeve 30.

Figure 8:
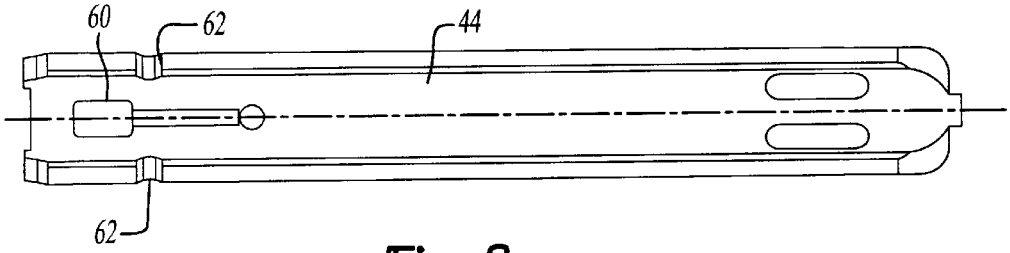
FIG. 8 is a detailed plan view showing the half-round spindle of the present invention.
Figure 9:
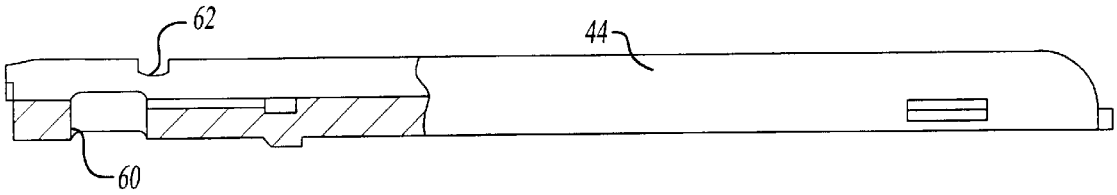
FIG. 9 is a partial cross-sectional view showing the half-round spindle.

As previously indicated, lockset mechanism 20 is provided with an over-torque defense system which disables the lockset mechanism when an over-torque force has been applied thereto. In this regard, half-round spindle 44 is designed to fracture when an actuation torque has been applied to handle subassembly 22 which exceeds a maximum torque. More specifically, half-round spindle 44 may be provided with certain design features which initiate a fracture thereof when the maximum torque has been exceeded. For example, as best seen in FIGS. 8 and 9, a pair of notches 62 are formed at an end of half-round spindle 44 adjacent slot 60. Notches 62 locally reduce the cross-sectional area of half-round spindle 44, as well as function as a stress riser to locate and control the failure mode of half-round spindle 44. As presently preferred, notches 62 are formed at the edges of half-round spindle 44 and have a generally circular configuration. However, one skilled in the art will readily recognize that other stress risers may be adapted to the present invention to provide a particular failure mode of half-round spindle 44.

Half-round spindle 44 may also be heat treated in a manner such that the hardness of the material, typically soft cold-rolled steel, is increased. In this regard, half-round spindle 44 may be heat treated in the presence of ammonia such that it becomes case hardened (from a hardness of approximately 60 RB to approximately 30–40 RC) and brittle. With the use of stress risers and surface hardening, alone or in combination, the failure mode of half-round spindle 44 at the maximum torque force may be precisely controlled. Presently maximum torque in the range of 220–270 inchpounds is preferred and a maximum torque in the range of 240–250 inch-pounds is more preferred to provide an adequate over-torque defense system. However, one skilled in the art will readily recognize that the precise maximum torque range may be a function of the particular design and application of the lockset mechanism.

With reference again to FIG. 1–9, spindle subassembly 24 includes spring mechanism 64 operably coupled between rose liner 36 and torque spring mechanism 46 for urging spindle subassembly 24 axially away from exterior rose 32. Spring mechanism 64 includes spring seat 66 positioned adjacent the interior end 68 of exterior sleeve 30. A series of prongs 70 extend axially from exterior sleeve 30 and engage recesses 72 formed in spring seat 66. Conical coil spring 74 is operably disposed between spring seat 66 and torque spring mechanism 46 to generate an axial biasing force. More specifically, coil spring 74 normally biases spindle subassembly 24 away from handle subassembly 22 such that when half-round spindle 44 fractures due to the application of an over-torque to handle subassembly 22, coil spring 74 forces full-round spindle 42 away from handle subassembly 22 and out of driving engagement with lock cylinder 40. Thus, full-round spindle 42 is no longer in driving engagement with lock cylinder 40 and a portion of half-round spindle 44 and torsion spring mechanism 46 move axially away from handle subassembly 22 in the direction of arrow A shown in FIGS. 3 and 5. As a result, when the over-torque condition is reached, spindle subassembly 24 is fully disabled. In this disabled state, handle subassembly 22 freely spins and the locking mechanism of lockset 20 is protected. While a conical coil spring is presently preferred, one skilled in the art will readily recognize that other biasing means such as a helical coil spring, a wave washer, a spring washer or other equivalent mechanisms for generating an axial biasing force may be utilized for urging spindle subassembly 24 away from handle subassembly 22.

Figure 11:
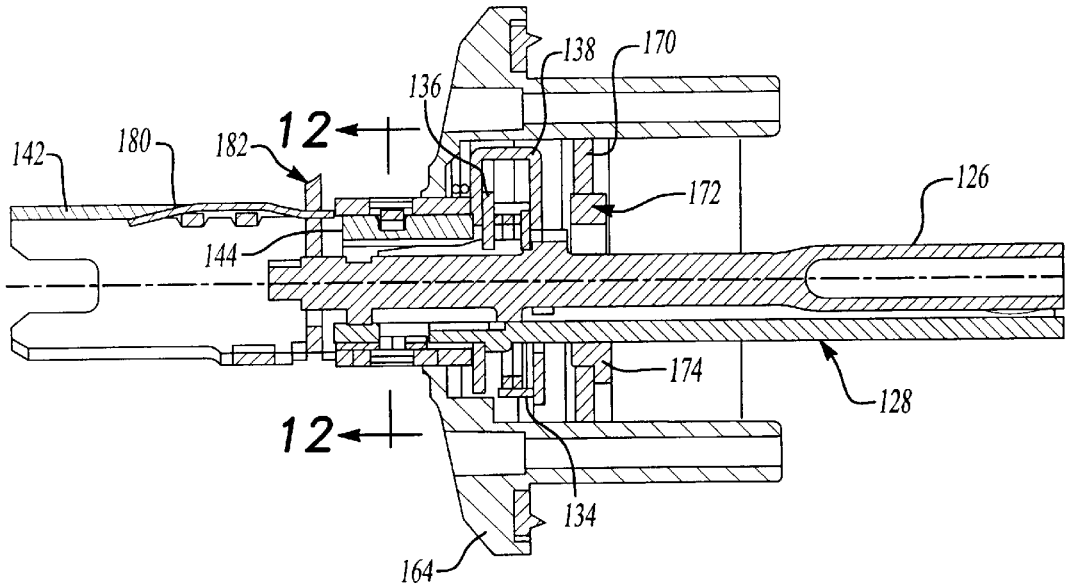
FIG. 11 is a transverse cross-section of the second preferred embodiment illustrated in FIG. 10.
Figure 12:
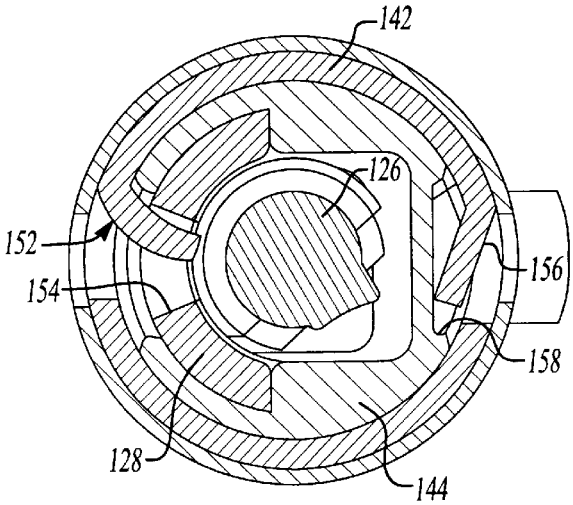
FIG. 12 is a cross-section taken along the line XII—XII shown in FIG. 11.
Figure 10:
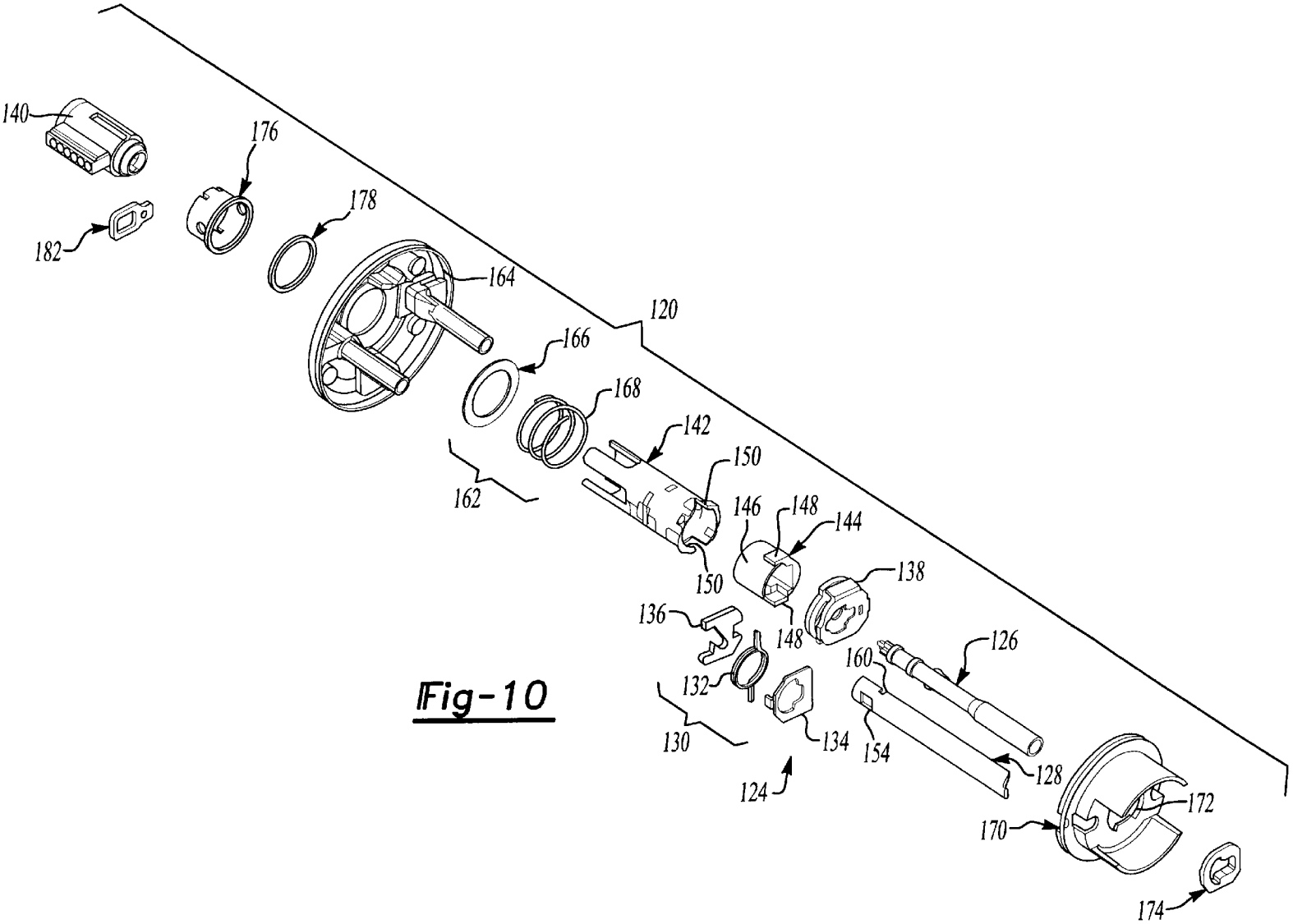
FIG. 10 is an exploded perspective view of a second preferred embodiment of the present invention.

With reference now to FIGS. 10–12, a second preferred embodiment of the present invention is illustrated. Lockset mechanism 120 includes handle subassembly 122 and spindle subassembly 124 which is operably coupled to a latch bolt subassembly (not shown). Lockset mechanism 120 is particularly adapted to include a low-cost over-torque defense system similar to that incorporated in lockset mechanism 20 previously described. More specifically, spindle subassembly 124 includes full-round spindle 126 and half-round spindle 128 operably disposed within torque spring mechanism 130 which includes torsion spring 132, locking slide members 134, 136 and torsion spring housing 138. Full-round spindle 126 is operably coupled to locking slide 136 such that rotation of full-round spindle 126 moves locking slide 136 in the transverse direction from an unlocked condition to a locked condition for inhibiting rotation of spindle subassembly 124 to disable the latch bolt subassembly. Full-round spindle 126 is operably coupled at the end adjacent handle subassembly 122 to lock cylinder 140. Similarly, the interior end of full-round spindle 126 is operably coupled to a turn mechanism operably associated with the interior handle subassembly (not shown).

Half-round spindle 128 is operably coupled to exterior handle subassembly 122 for rotation therewith. More specifically, the exterior end of half-round spindle 128 is received within exterior sleeve 142. Insert 144 having a complementary surface 146 to half-round spindle 128 is also inserted within exterior sleeve 142. A pair of radially extending details 148 are formed on insert 144 and adapted to engage the edges of half-round spindle 128. Details 148 are also received within slot 150 formed in the end of exterior sleeve 142. In this manner, half-round spindle 128, exterior sleeve 142 and insert 144 are coupled together for co-rotation. As best seen in FIG. 12, exterior sleeve 142 has an inwardly extending tab 152 formed thereon which is adapted to be received within slot 154 of half-round spindle 128. Similarly, tab 156 formed on exterior sleeve 142 extends into groove 158 formed in insert 144. In this manner, details 148 operably couple half-round spindle 128, exterior sleeve 142 and insert 144 for co-rotation while tabs 152, 156 fix these components axially.

As with half-round spindle 44 (of the first preferred embodiment), half-round spindle 128 is provided with certain design features which cause half-round spindle 128 to fracture when an over-torque force has been applied to lockset mechanism 120. More specifically, notches 160 are formed in the peripheral edges of half-round spindle 128 adjacent slot 154. In addition, half-round spindle 128 may be heat treated to provide a desired range of hardness, thereby increasing its brittleness. In this manner, half-round spindle 128 is particularly adapted to fracture at a location adjacent notches 160 when the over-torque force is applied.

With reference again to FIGS. 10 and 11, spindle subassembly 124 further includes spring mechanism 162 operably disposed between rose liner 164 and torsion spring mechanism 130 for biasing spindle subassembly 124 away from exterior handle subassembly 122. Spring mechanism 162 includes spring seat 166 engaging an inner surface of rose liner 164 and helical coil spring 168 operably disposed between spring seat 166 and torsion spring housing 138. Upon application of a turning force greater than the maximum allowable torque (i.e. an over-torque force), half-round spindle 128 fractures adjacent notches 160. Spring mechanism 162 urges full-round spindle 126 away from exterior handle subassembly 122 such that the exterior end thereof disengages lock cylinder 140, thereby disabling spindle subassembly 124.

To ensure the smooth operation of lockset mechanism 120, spindle subassembly 124 is rotatably supported by rose liner 164 at a side opposite exterior handle subassembly 122. More specifically, rose shield 170 extends axially inwardly from rose liner 164 and has a central aperture 172 formed therein which is adapted to receive bearing member 174. Full-round spindle 126 and half-round spindle 128 extend through a central portion of bearing member 174 and are rotatably supported by rose shield 170. Support collar 176 and washer 178 are operably disposed between the exterior knob (not shown) of handle subassembly 122 and rose liner 164 for enhancing the relative rotation therebetween. As best seen in FIG. 11, handle subassembly 122 further includes spring member 180 secured within exterior sleeve 142 and operably coupled to catch member 182 for retaining and rotatably coupling a knob with exterior sleeve 142.

While the present invention has been described with particular reference to preferred embodiments, one skilled in the art will readily recognize from the foregoing discussion and accompanying drawings and claims that various changes, modifications and variations can be made in the present invention without departing from the spirit and scope thereof as defined in the following claims.

What is claimed is:

1. A lockset mechanism comprising:

a handle subassembly including a rose member having an aperture formed therein, a sleeve received in said aperture and rotatably supported by said rose member, a handle secured to a first end of said sleeve, and a lock cylinder received in said handle;

a latch bolt subassembly having a latch bolt positionable between an extended position and a retracted position;

a spindle subassembly including a first spindle having a first end secured to said sleeve and a second end in driving engagement with said latch bolt for operably coupling said handle subassembly to said latch bolt subassembly, a lock mechanism secured to said first spindle between said sleeve and said latch bolt and having a locking slide positionable between a locked condition to engage said rose member for preventing rotation of said first spindle and an unlocked condition to disengage said rose member for permitting rotation of said first spindle, a second spindle having a first end in driving engagement with said lock cylinder and operably coupling said lock cylinder to said lock mechanism for manipulating said locking slide between said locked condition and said unlocked condition, and a spring operably disposed between said rose member and said lock mechanism for axially biasing said spindle subassembly away from said rose member; and said first spindle having a fracture mechanism for severing said first spindle between said first end and said second end when a predetermined torque level is applied thereto;

wherein said first spindle fractures at said fracture mechanism when a torque in said first spindle is equal to or greater than said predetermined torque level causing said spring to axially move said spindle subassembly away from said handle subassembly such that said second end of said first spindle is uncoupled from said handle subassembly and said second spindle is out of driving engagement with said lock cylinder.

2. The lockset mechanism of claim 1 wherein said fracture mechanism comprises a stress riser formed in the first spindle adjacent said lock mechanism.

3. The lockset mechanism of claim 1 wherein said fracture mechanism comprises at least a portion of the first spindle being hardened to a predetermined hardness.

4. The lockset mechanism of claim 3 wherein said fracture mechanism further comprises a stress riser formed in the hardened portion of the first spindle.

5. A lockset mechanism comprising:

a housing having an aperture formed therein;

a sleeve received in said aperture and rotatably supported by said housing;

a lock cylinder supported in said sleeve;

a latch bolt positionable between an extended position and a retracted position;

a first spindle having a first end secured to said sleeve, a second end extending through an aperture formed in said latch bolt for operably coupling said sleeve to said latch bolt, and a fracture mechanism for severing said first spindle between said first end and said second end when a predetermined torque level is applied to said first spindle;

a lock mechanism secured to said first spindle between said sleeve and said latch bolt and having a locking slide moveable between a unlocked position to permit rotation of said first spindle and a locked position to prevent rotation of said first spindle;

a second spindle having a first end in driving engagement with said lock cylinder and extending through said lock mechanism and said latch bolt, said second spindle being rotatably supported by said lock mechanism such that rotation of said second spindle moves said locking slide between said unlocked position and said locked position; and a spring interdisposed between said housing and said lock mechanism to axially bias said second spindle away from said housing;

wherein said first spindle fractures at said fracture mechanism when a torque in said first spindle is equal to or greater than said predetermined torque level causing said spring to axially move said second spindle away from said housing such that said second end of said first spindle is uncoupled from said housing and said second spindle is out of driving engagement with said lock cylinder.

6. The lockset mechanism of claim 5 wherein said fracture mechanism comprises a stress riser formed in said first spindle adjacent said lock mechanism.

7. The lockset mechanism of claim 5 wherein said fracture mechanism comprises at least a portion of said first spindle being hardened to a predetermined hardness.

8. The lockset mechanism of claim 7 wherein said fracture mechanism further comprises a stress riser formed in said hardened portion of said first spindle.

9. The lockset mechanism of claim 5 further comprising a spring seat interdisposed between said housing and said spring.

10. The lockset mechanism of claim 5 wherein said first end of said first spindle has a slot formed therein and is received in said sleeve, said sleeve having a tab extending into said slot for securing said first spindle to said sleeve.

11. The lockset mechanism of claim 10 further comprising an insert secured in said sleeve such that said first spindle is disposed within said sleeve and said insert.

* * * * *